US005458351A

United States Patent [19]

Yu

[11] Patent Number: 5,458,351

[45] Date of Patent: Oct. 17, 1995

[54] SKATE BOARD COMBINATION

[76] Inventor: Fu B. Yu, No. 56, Min Sheng Street, Feng Yuan, Taichung, Taiwan

[21] Appl. No.: 368,154

[22] Filed: Dec. 19, 1994

[51] Int. Cl.[6] ..... A63C 17/00

[52] U.S. Cl. ..... 280/87.042; 280/11.28; 280/87.043

[58] Field of Search ..... 280/87.041, 87.042, 280/87.043, 14.2, 14.3, 11.19, 11.27, 11.28

[56] References Cited

U.S. PATENT DOCUMENTS 4,930,794 6/1990 Chan ..... 280/87.042

4,955,626 9/1990 Smith et al. ..... 280/87.042

5,273,384 12/1994 Smith ..... 280/87.042

*Primary Examiner*—Richard M. Camby

*Attorney, Agent, or Firm*—Charles E. Baxley

[57] ABSTRACT

A skate board includes a beam including two hubs disposed on the end portions. Two axles each includes two wheels and each includes a shaft extended upward through the hubs. A pair of foot supports are secured on top of the shafts and rotated in concert with the shafts, and each includes two curved grooves. A stop bolt is engaged in each of the curved grooves for engaging with the beam so as to limit rotational movement of the foot supports. Another foot support is force-fittedly supported on the middle portion of the beam.

2 Claims, 3 Drawing Sheets

SKATE BOARD COMBINATION

BACKGROUND OF THE INVENTION

1. Field of the Invention

The present invention relates to a skate device, and more particularly to a skate board combination.

2. Description of the Prior Art

A typical skate board comprises a beam having two pairs of wheels provided on the bottom of the end portions of the beam, and two foot supports secured on top of the end portions of the beam. The foot supports may not rotate freely.

The present invention has arisen to mitigate and/or obviate the afore-described disadvantages of the conventional skate boards.

SUMMARY OF THE INVENTION

The primary objective of the present invention is to provide a skate board combination in which the foot supports may rotate freely and may be limited to rotate within suitable angles.

In accordance with one aspect of the invention, there is provided a skate board combination comprising a beam including two ends each having a hub provided thereon, and including a middle portion, a pair of axles each including wheel means secured thereto and each including a shaft extended upward therefrom and engaged upward through the hubs so as to allow free rotation in the hubs, a pair of first foot supports secured on top of the shafts respectively and rotated in concert with the shafts, the first foot supports each including at least one groove formed therein, stop means engaged in the groove for engaging with the beam so as to limit rotational movement of the first foot supports, a second foot support provided above the middle portion of the beam, and retaining means provided on the middle portion of the beam for retaining the second foot support in place. The first foot supports may rotate freely or may rotate within suitable angles relative to the beam.

The first foot supports each includes an upwardly arched toe stirrup and a forwardly arched toe stop secured thereon for engaging with and for retaining the feet of the users in place.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
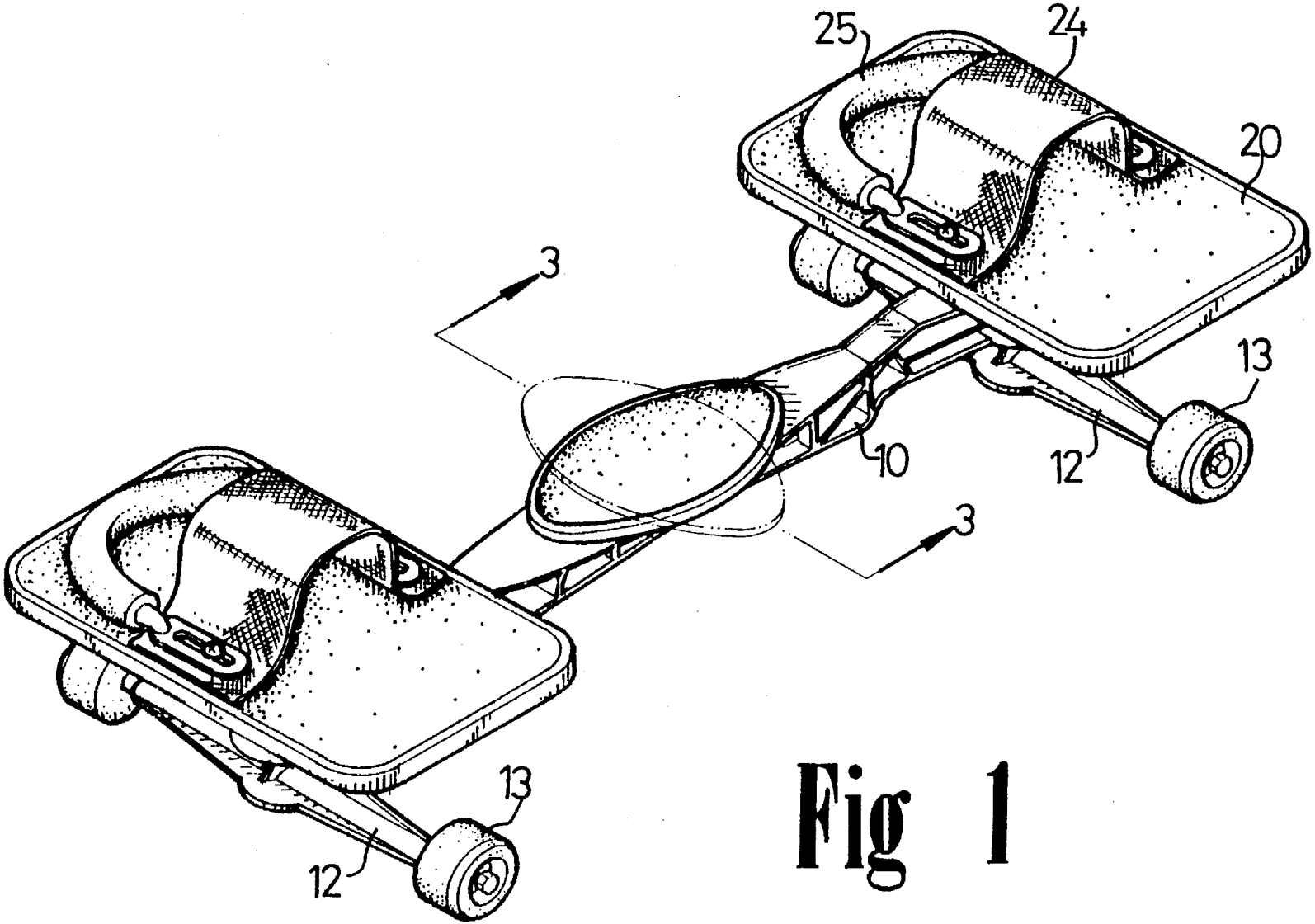
FIG. 1 is a perspective view of a skate board combination in accordance with the present invention.
Figure 2:
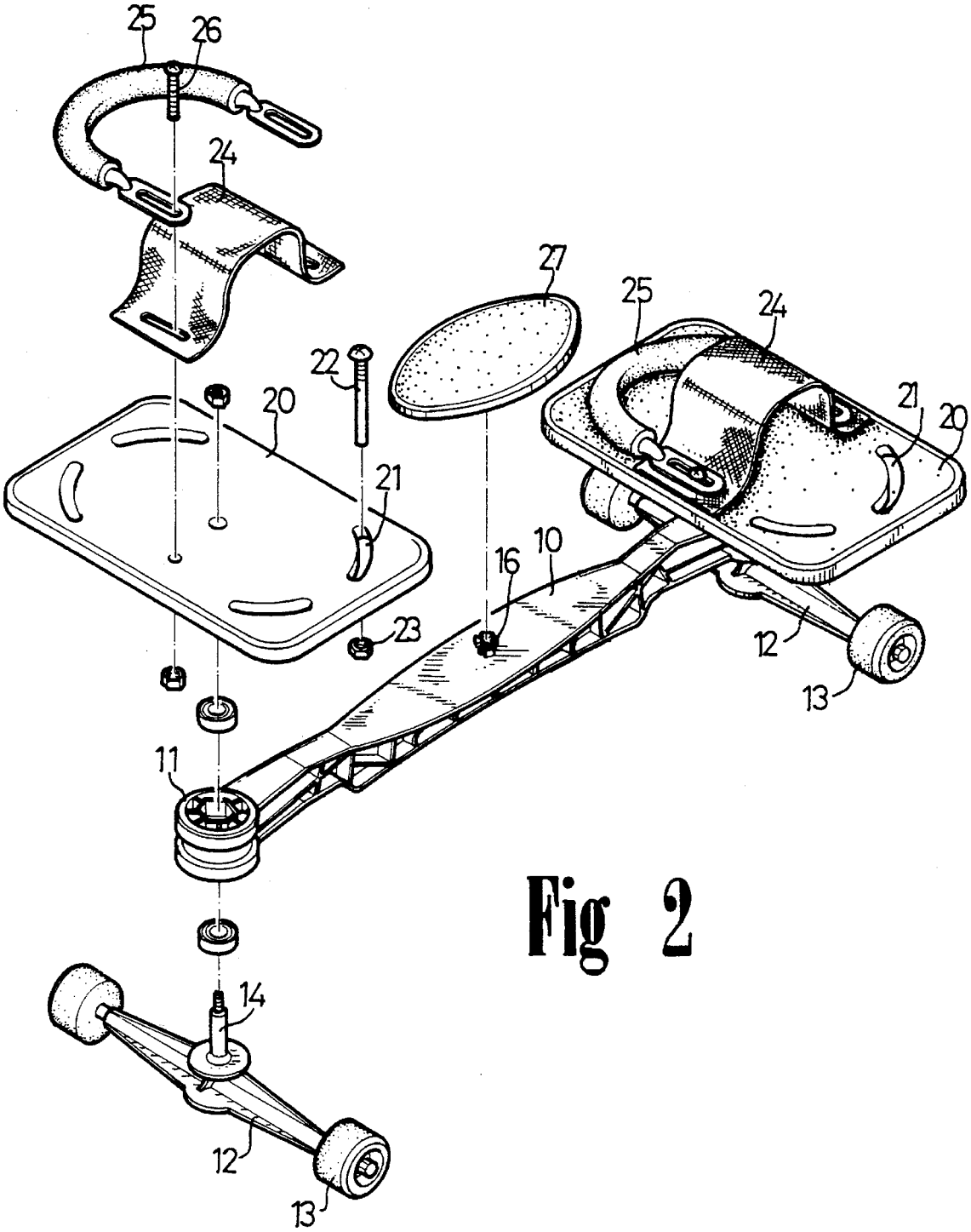
FIG. 2 is a partial exploded view of the skate board combination.
Figure 3:
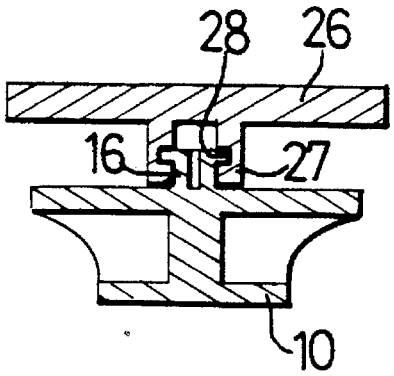
FIG. 3 is a cross sectional view taken along lines 3—3 of FIG. 1.
Figure 4:
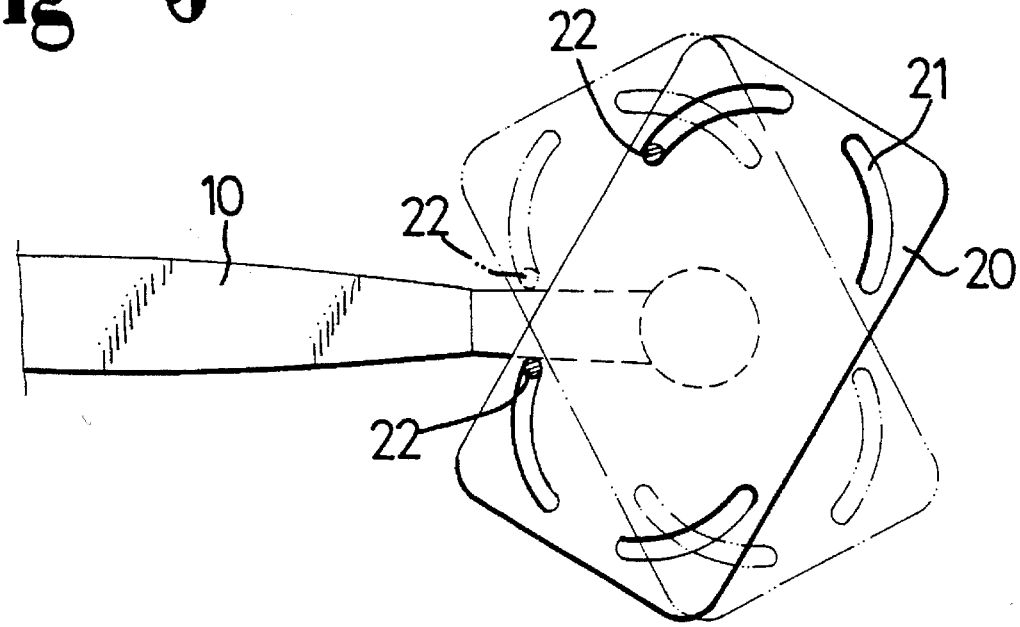
FIG. 4 is a partial top plane view illustrating the operation of the skate board combination.

Referring to the drawings, and initially to FIGS. 1 to 3, a skate board combination in accordance with the present invention comprises a beam 10 including two hubs 11 provided on the end portions thereof. Two axles 12 each includes two wheels 13 secured thereto and each includes a shaft 14 extended upward therefrom for engaging through the hubs 11 respectively. Bearing means 15 are engaged between the shaft 14 and the hub 11 for rotatably supporting the shaft 14 within the hub 11 such that the shafts 14 are freely rotatable about the hubs 11. Two foot supports 20 are secured on top of the shafts 14 respectively and rotated in concert with the shafts 14 and the axles 12. The foot supports 20 each includes two pairs of curved grooves 21 formed therein for engaging with bolts 22 which are secured to the foot supports 20 by nuts 23. The bolts 22 may be secured to suitable positions along the curved grooves 21 for engaging with the beam 10 so as to limit the rotational movement of the foot supports 20, best shown in FIG. 4. When the bolts 22 are disengaged from the foot supports 20, the foot supports 20 may freely rotate about the shaft 14. An upwardly arched toe stirrup 24 and a forwardly arched toe stop 25 are secured on top of each of the foot supports 20 for engaging with feet of the users.

Referring again to FIGS. 1 to 3, a resilient chuck or retaining means 16 is provided on the middle portion of the beam 10 for engaging with the annular slot 28 of a hub 27 which is secured to the bottom portion of an auxiliary foot support 26. The auxiliary foot support 26 is secured to the retaining means 16 by force-fitted engagement such that the auxiliary foot support 26 may be retained in suitable position relative to the beam 10 by the retaining means 16 and may be rotated relative to the retaining means 16 against the resilient force of the retaining means 16 applied to the hub 27.

Accordingly, the skate board combination in accordance with the present invention includes two foot supports 20 that may be rotated freely and that may be limited to rotate within suitable angles.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A skate board combination comprising:

a beam including two ends each having a hub provided thereon, and including a middle portion, a pair of axles each including wheel means secured thereto and each including a shaft extended upward therefrom and engaged upward through said hubs so as to allow free rotation in said hubs, a pair of first foot supports secured on top of said shafts respectively and rotated in concert with said shafts, said first foot supports each including at least one groove formed therein, stop means engaged in said groove for engaging with said beam so as to limit rotational movement of said first foot supports, a second foot support provided above said middle portion of said beam, and retaining means provided on said middle portion of said beam for retaining said second foot support in place.

2. A skate board combination according to claim 1, wherein said first foot supports each includes an upwardly arched toe stirrup and a forwardly arched toe stop secured thereon.

* * * * *